US005775699A

United States Patent [19]

Orito et al.

[11] Patent Number: 5,775,699

[45] Date of Patent: Jul. 7, 1998

[54] APPARATUS WITH SHOOTING TARGET AND METHOD OF SCORING TARGET SHOOTING

[75] Inventors: Masaomi Orito, Tokyo; Nobutaka Hirata, Sakura; Satoshi Kimura, Tokyo; Kazuo Asaka, Tokyo; Shigeo Uehara, Tokyo, all of Japan

[73] Assignee: Shibasoku Co., Ltd., Tokyo, Japan

[21] Appl. No.: 582,624

[22] Filed: Jan. 4, 1996

[30] Foreign Application Priority Data

| | | | |
|---|---|---|---|
| Jan. 11, 1995 | [JP] | Japan | 7-018375 |
| Jan. 24, 1995 | [JP] | Japan | 7-027211 |
| Mar. 8, 1995 | [JP] | Japan | 7-078344 |

[51] Int. Cl.[6] ..... F41J 5/00; F41J 1/10

[52] U.S. Cl. ..... 273/371; 273/406; 273/403

[58] Field of Search ..... 273/371, 378, 273/403, 404, 406, 407, 410

[56] References Cited

U.S. PATENT DOCUMENTS

| | | | |
|---|---|---|---|
| 398,186 | 2/1889 | Rehfuss | 273/404 |
| 3,495,829 | 2/1970 | Booth | 273/404 |
| 3,519,272 | 7/1970 | Vogelaere | 273/404 |
| 3,944,227 | 3/1976 | Nilsson | 273/410 |
| 4,317,572 | 3/1982 | Iseli | 273/406 |
| 4,583,744 | 4/1986 | Tolliver et al. | 273/378 |
| 5,145,133 | 9/1992 | France | 273/407 |

FOREIGN PATENT DOCUMENTS

| | | | |
|---|---|---|---|
| 1744415 | 6/1992 | Russian Federation | 273/378 |

*Primary Examiner*—Mark S. Graham
*Attorney, Agent, or Firm*—Varndell Legal Group

[57] ABSTRACT

On a base plate 13 there are provided L-shaped posts 16 and 17 having horizontal arms 16*a* and 17*a* and upright portions 16*b* and 17*b*, respectively, and a shooting target 11 is provided exchangeable manner between the upright portions. On the base plate 13 there is arranged a video camera 14 obliquely with respect to the shooting target 11. A picked-up image of the shooting target 11 is supplied to a processing device 15. On the horizontal arms 16*a* and 17*a*, there is arranged a reflection mirror 18 movably. The mirror 18 is adjusted such that light scattered by the mirror is made incident upon the video camera 14 through a bullet hole C formed in the shooting target 11 with a bullet A discharged from a gun P. An image of the bullet hole C is picked-up as a bright spot, so that a position of the bullet hole in the shooting target can be detected accurately and easily.

5 Claims, 9 Drawing Sheets

APPARATUS WITH SHOOTING TARGET AND METHOD OF SCORING TARGET SHOOTING

BACKGROUND OF THE INVENTION

1. Field of the Invention

The present invention relates to a shooting target apparatus placed in a shooting contest field or firing range and including a shooting target which is positioned automatically at a given point, an image pick-up means for picking-up an image of a bullet hole or bullet mark formed in the shooting target, and a means for making a score of shooting on the basis of the picked-up image of the bullet mark.

2. Related Art Statement

Heretofore, in a shooting game, a score is made by viewing a shooting mark in a shooting target by means of a binocular. Recently, it has been proposed to pick-up an image of the shooting target and a position of a bullet hole is automatically detected by processing a picked-up image, a score is made on the basis of the detected position of the bullet hole, and a thus made score is displayed on a display monitor.

The image pick-up means is arranged movably in front of the shooting target or is fixed obliquely with respect to the shooting target. When the image pick-up means is arranged movably, the image pick-up means is removed from the shooting target during the shooting, and after shooting the image pick-up means is moved in front of the target in order to pick-up the image of the shooting target. When the image pick-up means is fixed obliquely with respect to the shooting target, a circular target image is distorted into a substantially elliptical shape. Therefore, the pick-up image has to be processed into a circular image.

FIG. 1 is a side view of a known shooting target apparatus, in which a shooting target T is secured to a rear plate 2 positioned on a base plate 1. In the rear plate 2, there is formed an opening 2*a* through which a bullet A discharged from a gun P can pass without damaging the rear plate. The bullet A is driven into a fill B for the sake of safety. The shooting target T is illuminated with natural light from the sun S, and an image of the shooting target T is pick-up by a video camera 3 placed in front of the target obliquely with respect to the target. A bullet hole made in the shooting target T by the bullet A is detected by processing the picked-up image by an image processing means 4 and a score of shooting is made. The position of the bullet hole may be detected by a difference between a before-shooting image and an after-shooting image.

The natural light is hardly reflected by the fill B, so that in the pick-up after-shooting image, the bullet hole formed by the bullet A becomes substantially black. Therefore, a contrast between the shooting target T and the bullet hole in the pick-up image is very low, and thus a position of the bullet hole in the shooting target T could not be accurately detected. Therefore, an illumination lamp 5 is provided behind the shooting target T such that the bullet hole in the pick-up image becomes bright and a contrast between the bullet hole and the shooting target is enhanced.

In the known shooting target apparatus mentioned above, since the illumination lamp 5 is provided behind the shooting target 2, an amount of light passing through the bullet hole toward the camera 3 is constant in regardless of a brightness of a front surface of the shooting target 2. Therefore, when cloudy weather changes to fine weather and an amount of natural light from the sun S is increased, contrast between the bullet hole image and the shooting target surface becomes decreased and a position of the bullet hole could not be detected easily. This demerit may be mitigated by changing a stop in the camera 3 in accordance with an amount of light around the shooting target T.

In general, the shooting target T is made of paper and is hung on the front surface of the rear plate 2, and therefore the target plate is liable to move by a wind blowing through the opening 2*a* formed in the rear plate 2. Then, a size and a shape of the target image picked-up by the camera 3 might be changed before and after shooting. In such a case, it is rather difficult to detect a position of a bullet hole in the shooting target T, because the before-shooting image and after-shooting image could not be coincided accurately.

If the above problem is solved by the image processing means 4, one of the before-shooting image and after-shooting image has to be corrected such that they are coincided with each other. Then, the image processing means 4 becomes complicated and a long processing time is required. Therefore, the image processing means 4 becomes expensive and a scoring time becomes long.

Moreover, in order to correct the elliptically distorted target image picked-up by the camera 3 arranged obliquely with respect to the target T, a whole image has to be rotated. To this end, an image processing program for treating a large amount of image data is liable to be complicated, and a very long image processing time is required.

In another known shooting target apparatus in which a shooting target is arranged movably with respect to the shooting target, it is necessary to move the image pick-up camera before and after shooting, so that the apparatus requires a rather large and complicated driving device. Moreover, the camera could not be moved at a high speed, a scoring time is prolonged.

SUMMARY OF THE INVENTION

The present invention has for its object to provide a novel and useful shooting target apparatus, in which the above mentioned problems of the known apparatuses can be mitigated, a position of a bullet hole formed in a shooting target can be detected accurately, and a shooting score can be derived within a short time.

According to the invention, a shooting target apparatus comprises a shooting target; an image picking-up means for picking-up an image of the shooting target to derive an image signal; an image processing means for processing said image signal supplied from the image picking-up means to detect a position of the bullet hole formed in the shooting target by means of a bullet; a scoring means for making a shooting score in accordance with said detected position of the bullet hole in the shooting target; and a light reflecting means provided on a line connecting said shooting target and said image picking-up means for reflecting light toward said image-picking up means via said shooting target.

In the shooting target apparatus according to the invention, natural light from the sun is reflected by the light reflecting means toward the image picking-up means through the bullet hole, so that contrast between the bullet hole image and the target image can be kept substantially constant in regardless of weather and a position of the bullet hole can be detected accurately.

According to another aspect of the invention, a shooting target apparatus comprises a shooting target; a rear plate having a front surface on which said shooting target is arranged, and an opening through which a bullet can pass; and a movable holding frame member for urging the shooting target against the front surface of rear plate at a periphery of the shooting target.

In this shooting target apparatus, the shooting target is urged against the rear plate, and thus the shooting target could not be moved by wind.

According to another aspect of the invention, a shooting target apparatus comprises a shooting target; an image picking-up means for picking-up an image of the shooting target to derive an image signal, said image picking-up means being arranged obliquely with respect to the shooting target; an image processing means for processing said image signal supplied from the image picking-up means to detect a position of the bullet hole formed in the shooting target by means of a bullet; and a scoring means for making a shooting score in accordance with said detected position of the bullet hole in the shooting target; wherein said image processing means is constructed to correct a position of a bullet hole in a picked-up elliptically distorted image into a position of a bullet hole in a corrected circular image in accordance with a distortion ratio.

In this shooting target apparatus, it is no more necessary to correct the elliptically distorted image into the circular image, so that image processing becomes simple and high speed.

The present invention also relates to a method of scoring a shooting target and has for its object to provide a novel and useful method of scoring a shooting target by a simple image processing.

According to the invention, a method of scoring a shooting target comprises the steps of:

(a) picking-up an image of a shooting target from an oblique direction with respect to the shooting target to derive a substantially elliptically distorted image of the shooting target;

(b) correcting a position of a bullet hole formed in the image of the shooting target by;

(1) determining a center of the substantially elliptically distorted image by deriving a cross point between a major axis and a minor axis;

(2) forming coordinates including said center, major axis and minor axis as an origin, ordinate and abscissa, respectively;

(3) dividing a whole area of said coordinates into a first area and a second area which situate on respective sides of said major axis;

(4) deriving a first distortion ratio in said first area and a second distortion ratio in said second area; and (5) correcting a position of a bullet hole in the substantially elliptically distorted image of the shooting target in accordance with said first or second distortion ratio when the bullet hole is positioned in said first or second area; and (c) making a score of a shooting in accordance with a distance between the origin and the corrected position of the bullet hole formed in the shooting target.

DESCRIPTION OF THE PREFERRED EMBODIMENT

Figure 1:
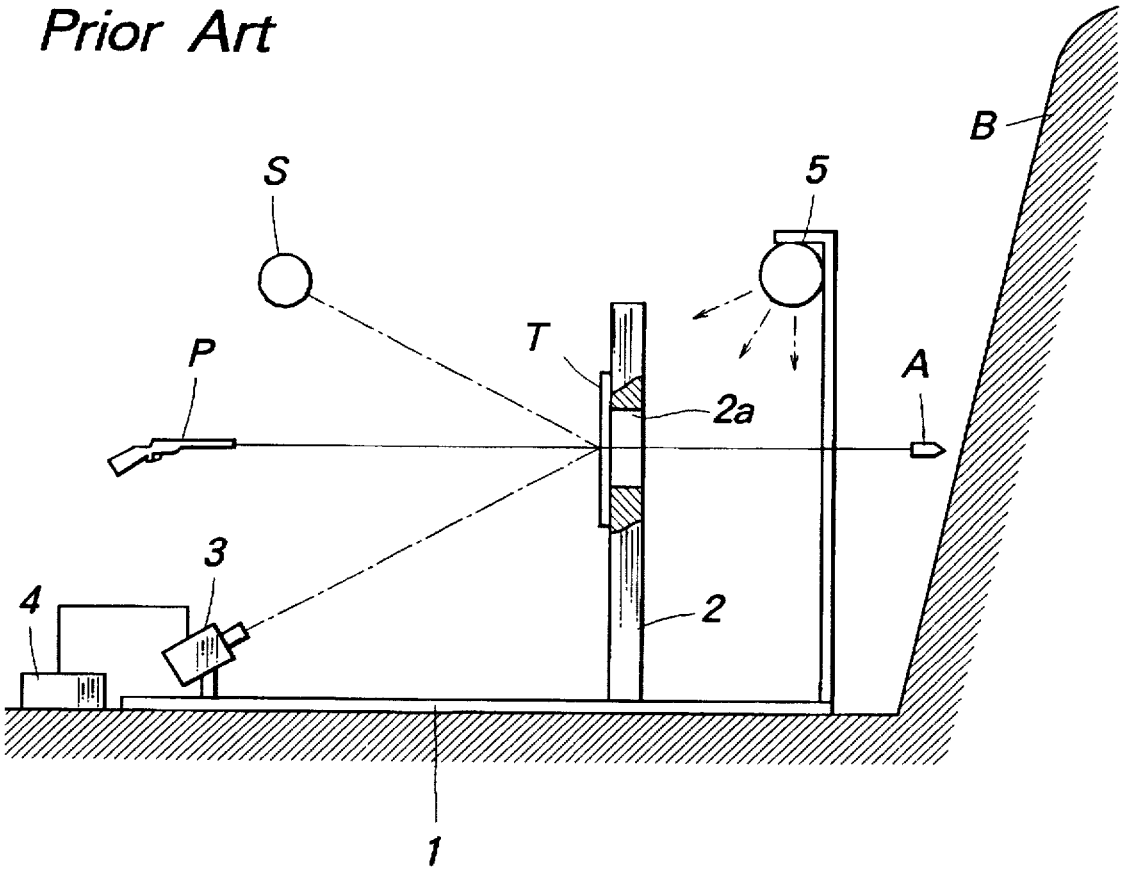
Fig. 1 Prior Art
FIG. 1 is a side view showing a known shooting target apparatus.
Figure 2:
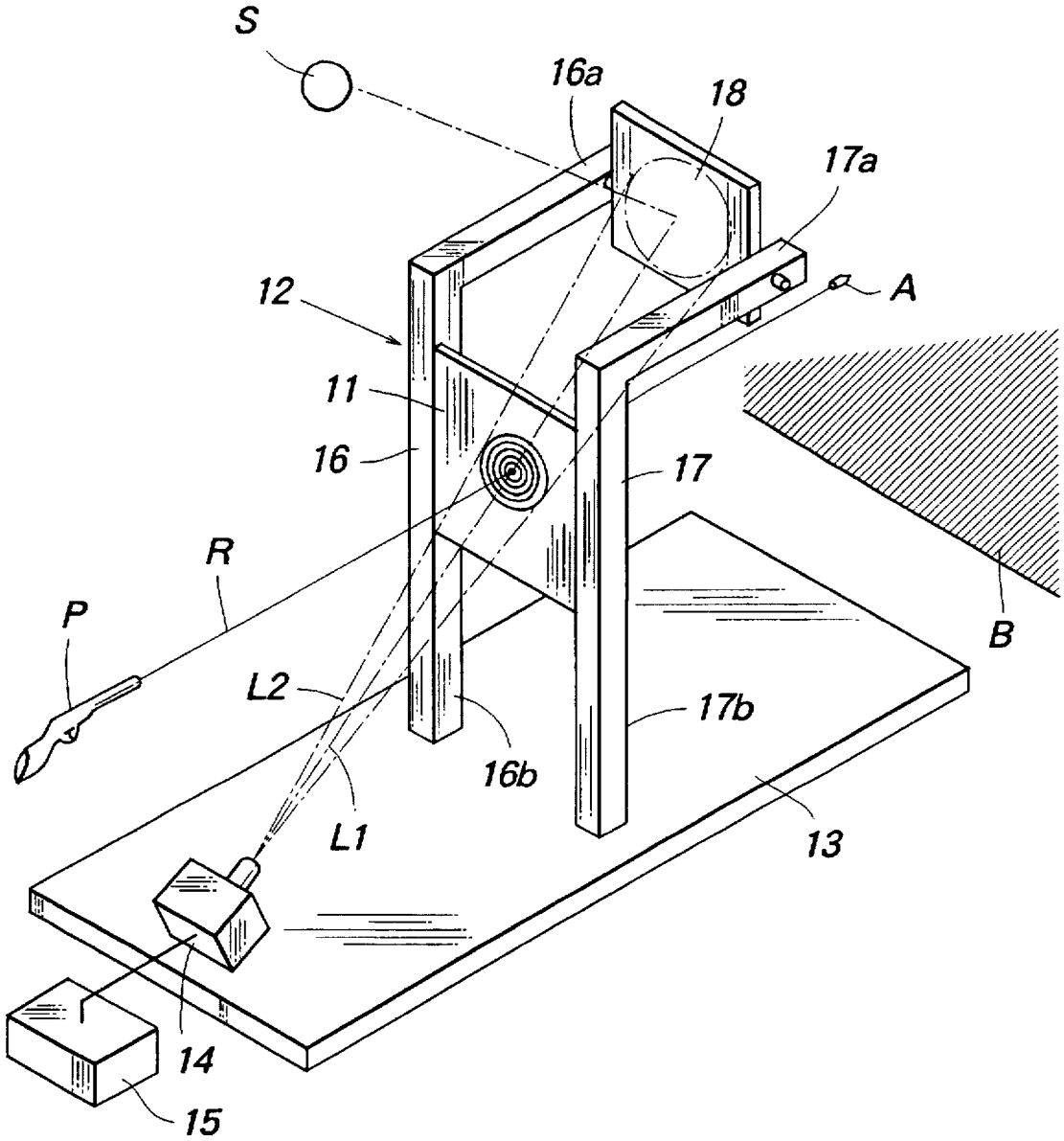
FIG. 2 is a perspective view illustrating an embodiment of the shooting target apparatus according to the invention.
Figure 3:
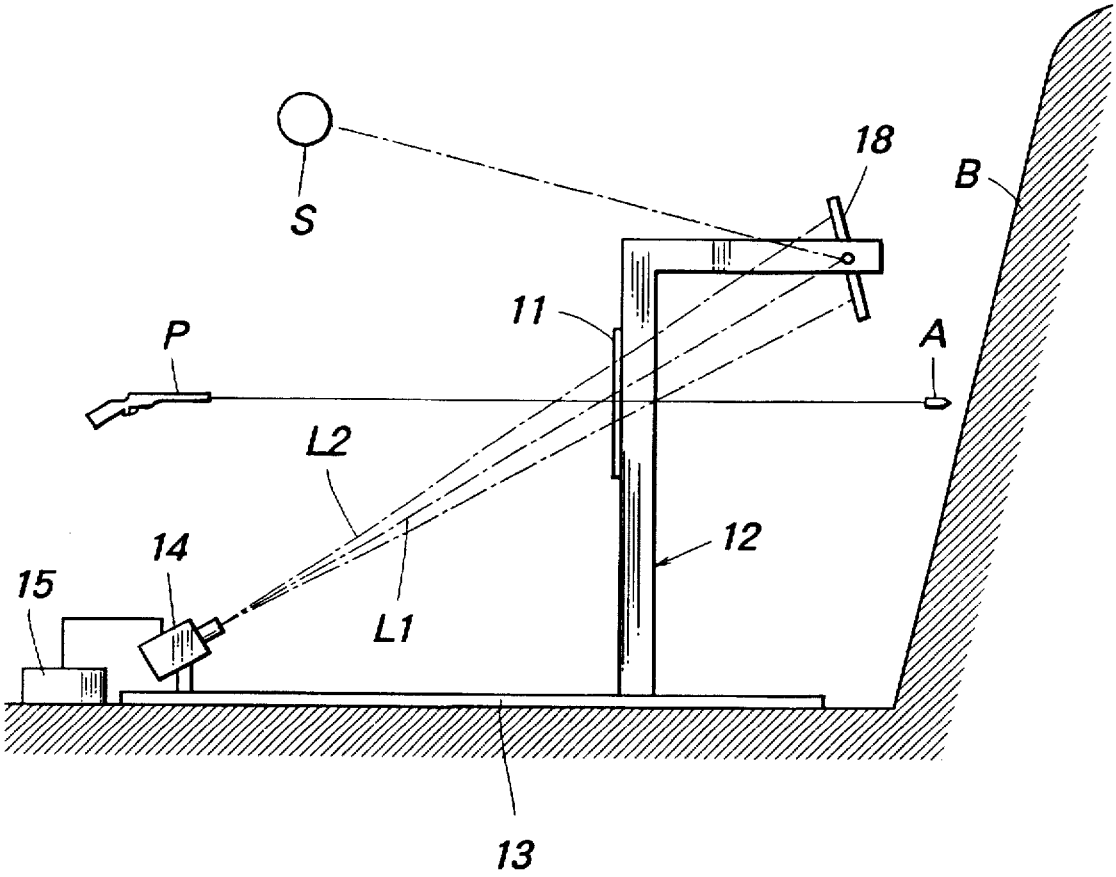
FIG. 3 is a side view of the embodiment.

FIG. 2 is a perspective view showing an embodiment of the shooting target apparatus according to the invention, and FIG. 3 is a side view thereof. A shooting target supporting device 12 for supporting movably a shooting target 11 is provided on a base plate 13 and is arranged in front of a fill B in a shooting contest field or firing range. On the base plate 13 there is further provided an image picking-up camera 14 for picking-up an image of the shooting target 11. The video camera 14 is arranged obliquely with respect to the shooting target 11, so that the camera does not interrupt shooting. To the video camera 14 is connected a processing device 15 for processing a picked-up image of the shooting target 11 and making a score of shooting.

On the base plate 13 there are further provided L-shaped posts 16 and 17. To horizontal arms 16*a* and 17*a* of these posts 16 and 17, a light reflection mirror 18 is secured movably. The light reflection mirror 18 has a milk-white light scattering surface, and is adjusted such that natural light from the sun S is reflected toward the camera 14 through the shooting target 11. It should be noted that the light reflection mirror 18 is arranged such that a bullet A discharged from a gun or pistol P does not hit the mirror. A center of the reflection mirror 18 is set on a line L1 connecting the video camera 14 and a center of the shooting target 11, and a size of the reflection mirror is set such that a line L2 connecting the video camera 14 and an outermost circle of the shooting target 11 intersects with the reflection mirror. The light reflection mirror 18 may be moved manually or automatically such that a rear surface of the shooting target 11 is illuminated with light scattered by the mirror 18, while a front surface of the shooting target 11 is irradiated with natural light from the sun S.

Figure 4:
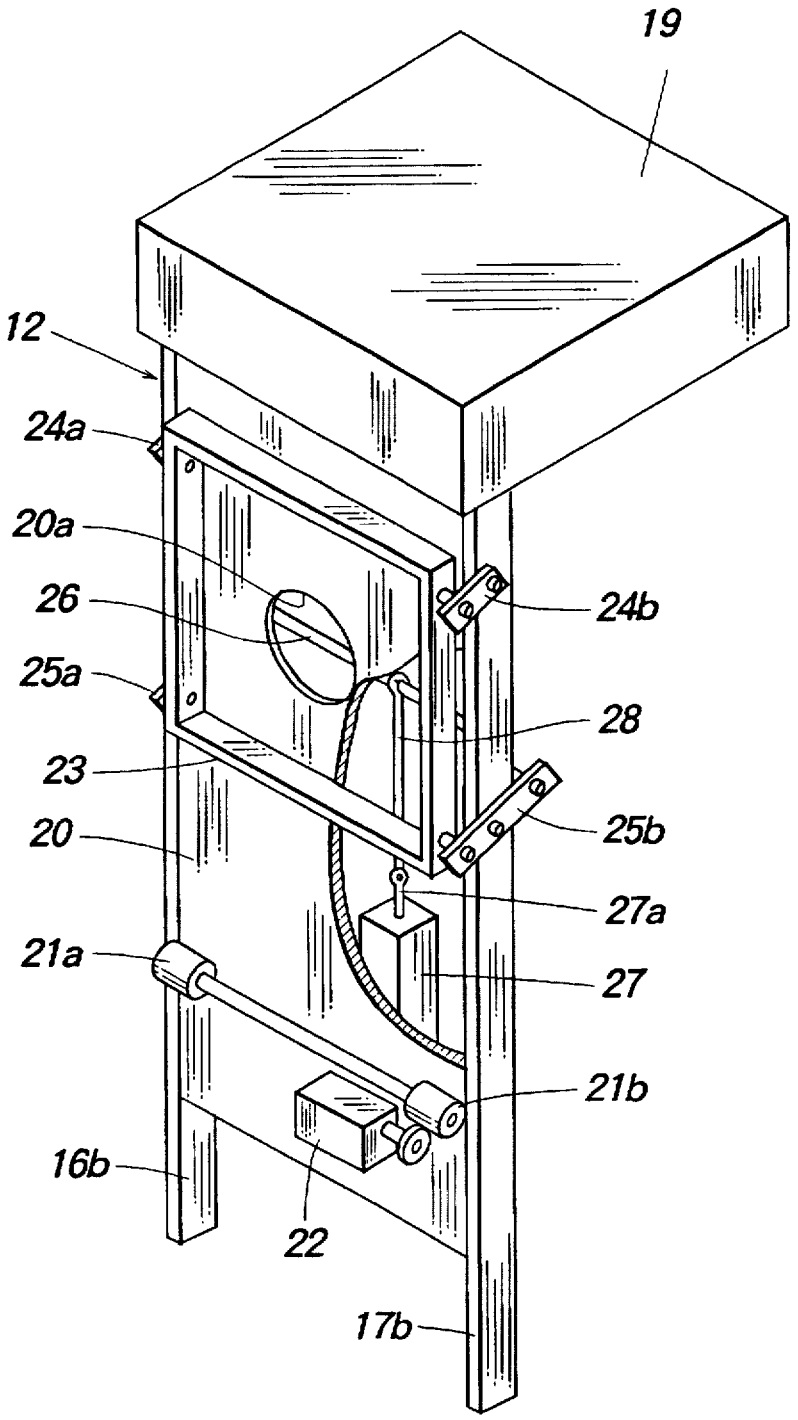
FIG. 4 is a partially cut away perspective view of the shooting target holding mechanism.
Figure 5:
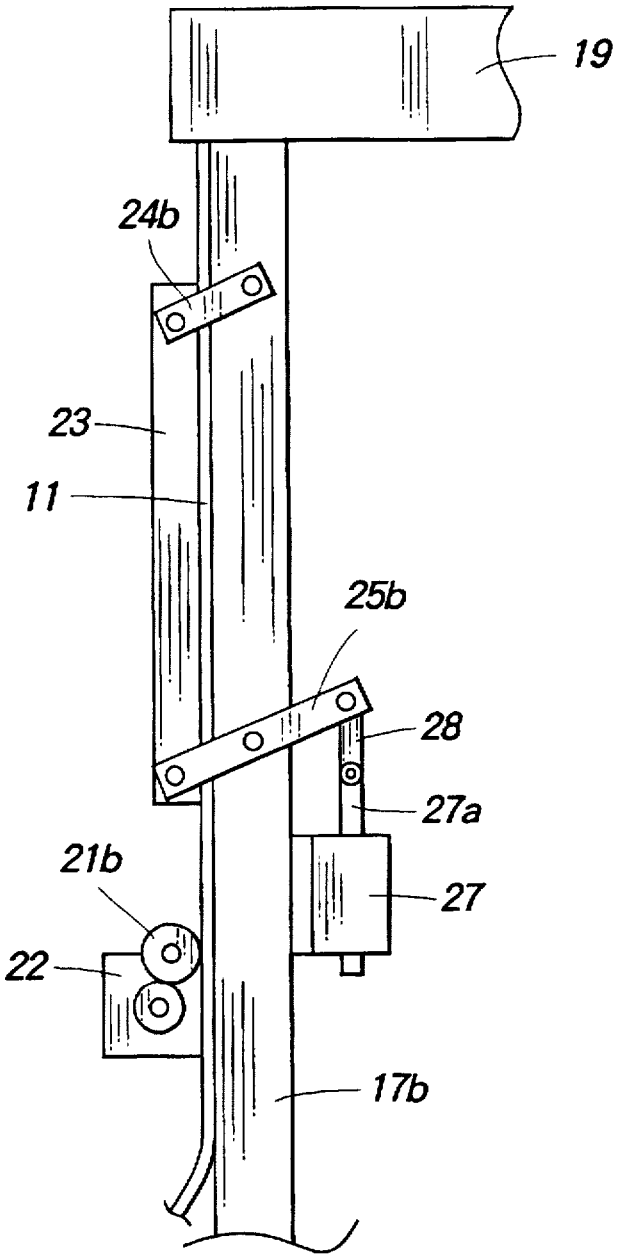
FIG. 5 is a side view of the shooting target holding mechanism.

As illustrated in FIGS. 4 and 5, a shooting target containing box 19 is arranged on the horizontal arms 16*a* and 17*a* of the posts 16 and 17. Within the box 19, there is contained a series of shooting targets in a folded condition. Between the upright portions 16*b* and 17*b* of the posts 16 and 17, there is provided a rear plate 20 having an opening 20*a* through which a bullet A can pass. At a lower portion of the upright portions 16*b* and 17*b*, there is arranged a shooting target take-up device including a pair of rollers 21*a* and 21*b* and a driving motor 22.

To the upright portions 16*b* and 17*b* of the posts 16 and 17, there is further provided a shooting target holding device including a holding frame 23 which is movable with respect to the rear plate 20. That is to say, an upper portion of the frame 23 is journaled by upper levers 24*a* and 24*b* and a lower portion of the frame is journaled by lower levers 25*a* and 25*b*. Ends of the lower levers 25*a* and 25*b* are connected by a horizontal connecting rod 26 which is coupled with a rod 27*a* of a plunger 27 by means of a vertical rod 28. The plunger 27 may be driven by a shooting target exchange command device as will be explained later.

Figure 6:
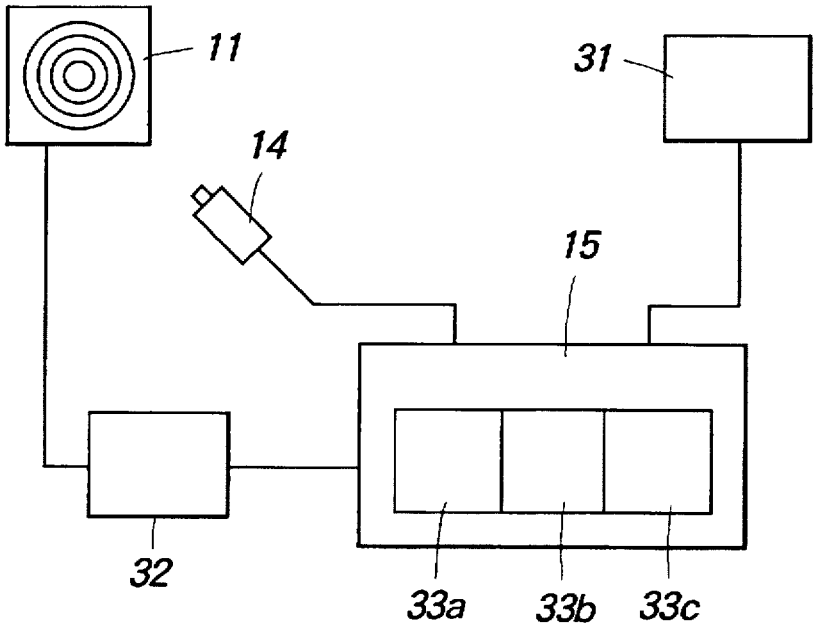
FIG. 6 is a block diagram depicting the shooting target apparatus of the embodiment.
Figure 7:
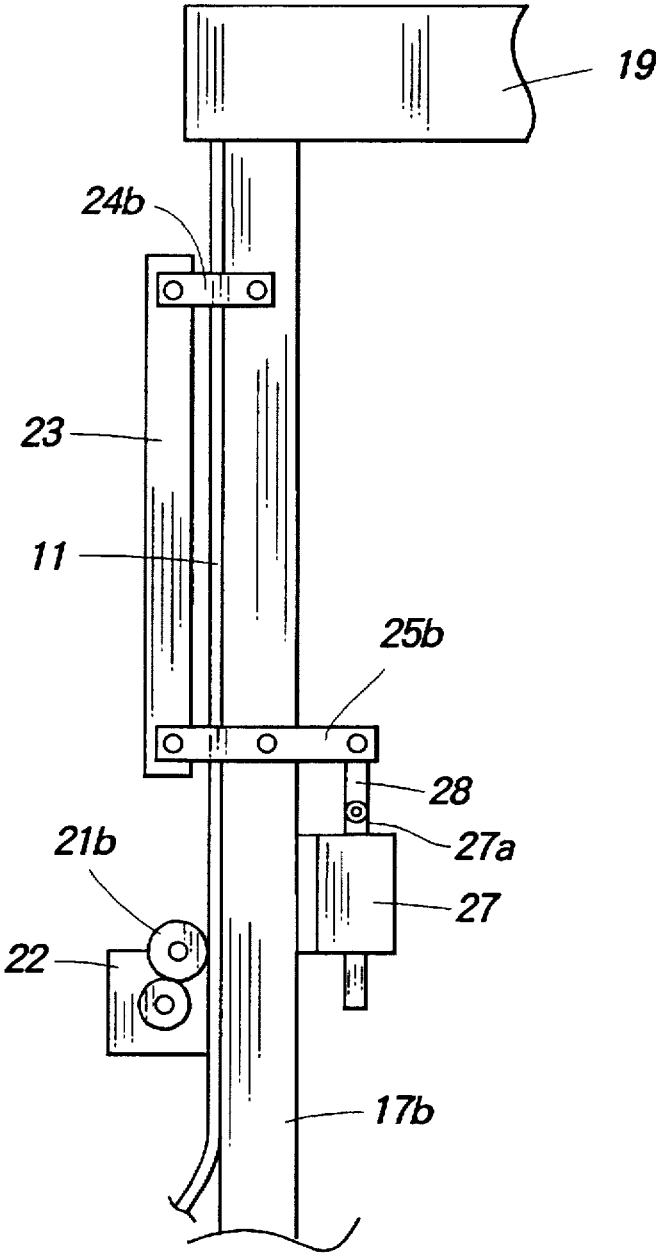
FIG. 7 is a side view showing operation of the shooting target holding mechanism.

As shown in FIG. 6, the processing device 15 is connected to a display means such as a television monitor 31 on which an image of the shooting target after shooting and a score may be displayed. Between the shooting target supporting device 12 and the processing device 15, there is further connected a shooting target exchange command device 32. When a shooting target is required to be exchanged, a command is sent to the shooting target supporting device 12 from the processing device 15 via the shooting target exchange device 32. The processing device 15 includes input means, calculating means, control means not shown in addition to a first memory 33*a* storing a before-shooting image of the shooting target, a second memory 33*b* storing an after-shooting image and a third memory 33*c* storing a difference between the before-shooting image and the after-shooting image.

When a shooting target exchange command is supplied from the processing device 15 to the shooting target supporting device 12 via the target exchange command device 32, the plunger 27 is driven such that the holding frame 23 is removed from the rear plate 20. Then, the motor 22 is energized to drive the rollers 21*a* and 21*b* to take-up the shooting target 11 from the box 19 such that a new shooting target 11 is placed at the opening 20*a* of the rear plate 20. Then, the plunger 27 is deenergized to move the frame 23 toward the rear plate 20 such that the shooting target 11 is urged against the rear plate.

Figure 8:
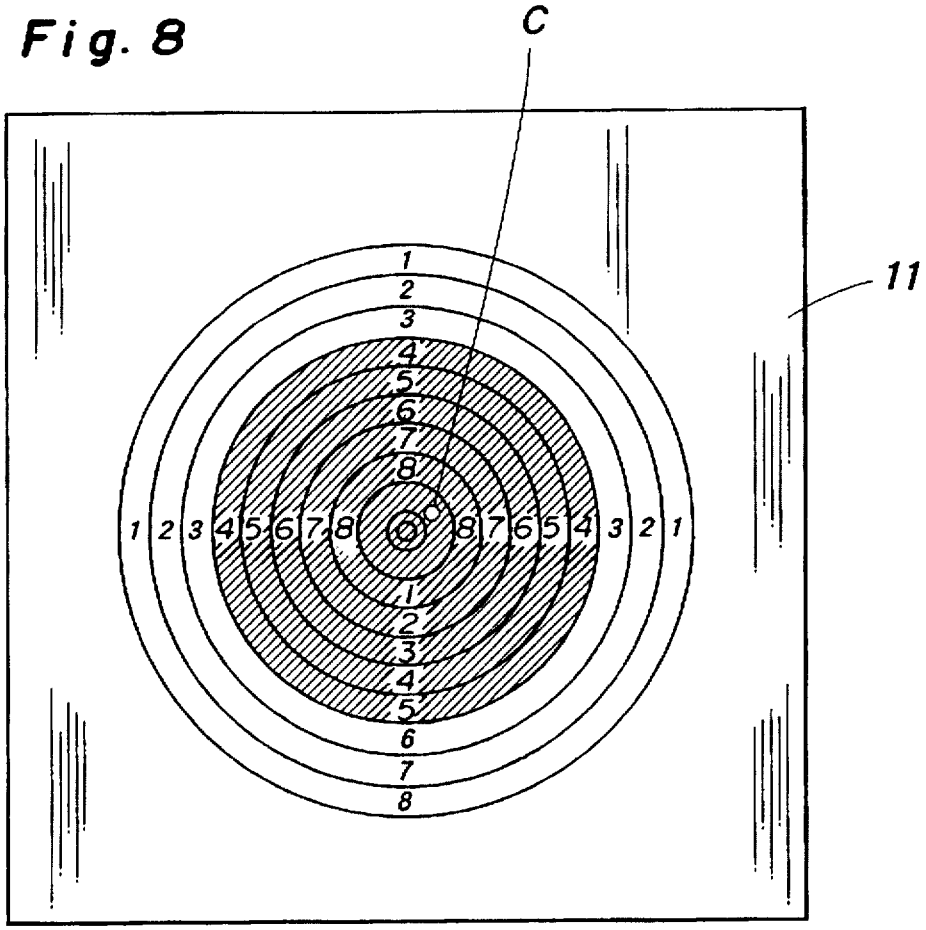
FIG. 8 is a front view of a shooting target with a bullet hole.

Upon shooting, there is formed in the shooting target 11 a bullet hole C as depicted in FIG. 8. Then, an image of the shooting target 11 is picked-up by the video camera 14. In this case, natural light reflected by the reflection mirror 18 is made incident upon the camera 14 via the bullet hole C formed in the shooting target, and thus the bullet hole is picked-up as a bright spot. By adjusting the reflection mirror 18, it is possible to adjust an amount of scattered light impinging upon the camera through the bullet hole C such that contrast between the bullet hole and the front surface of the shooting target becomes suitable. In this manner, an image of the bullet hole C can be clearly seen in the shooting target image. The thus picked-up image is supplied to the processing device 15 and is processed therein to detect a position of the bullet hole C. The thus detected position of the bullet hole C is displayed on the monitor 31.

Figure 9A:
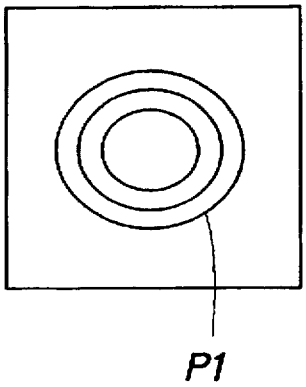
FIGS. 9(*a*), 9(*b*) and 9(*c*) are schematic views of a shooting target images.
Figure 9B:
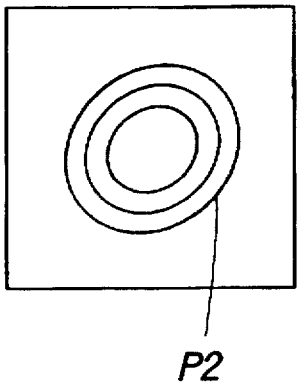
Figure 9C:
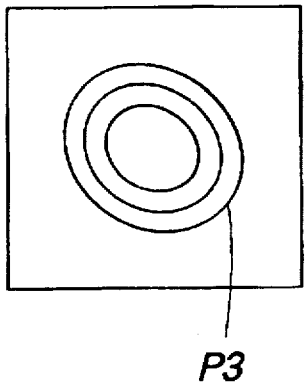

In general, on the front surface of the shooting target 11, there are formed a plurality of concentric circles. However, the video camera 14 is arranged obliquely with respect to the shooting target 11, the picked-up image of the shooting target is substantially elliptically distorted. That is to say, when the video camera 14 is arranged below a center of the shooting target 11, there is obtained a picked-up image P1 shown in FIG. 9*a*, when the camera is shifted rightward, a picked-up image P2 illustrated in FIG. 9*b* is obtained, and when the camera is arranged leftward, a picked-up image P3 shown in FIG. 9*c* is derived. At any position of the camera, the picked-up image of the shooting target 11 is distorted substantially elliptically.

Figure 10:
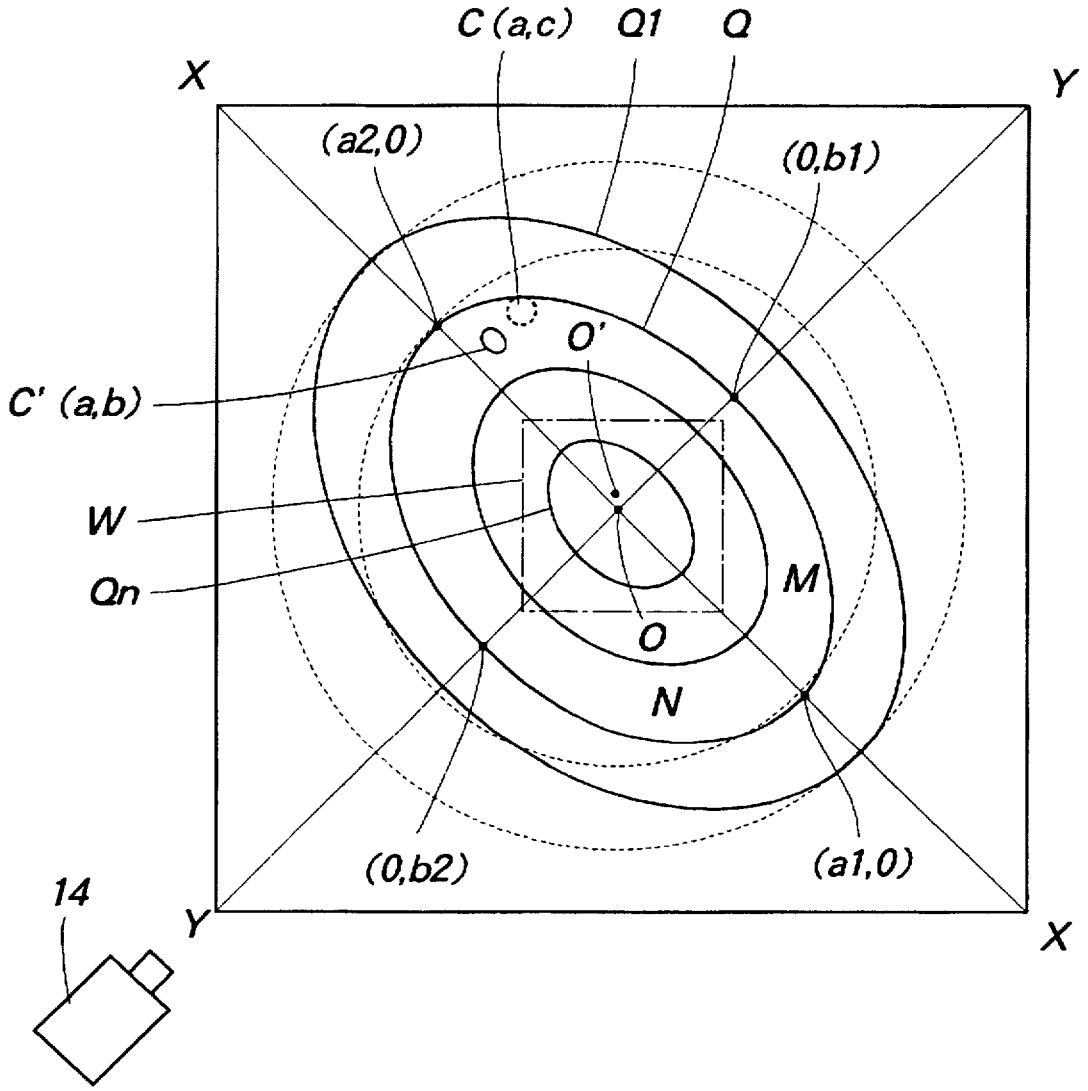
FIG. 10 is a schematic view illustrating a manner of correcting a position of a bullet hole in a shooting target image.

Therefore, upon detecting a position of the bullet hole C from the picked-up image, it is necessary to correct an actual position of the bullet hole image in the substantially elliptically distorted image. Now this correcting method will be explained with reference to FIG. 10.

(1) At first, a before-shooting image of the shooting target 11 is picked-up by the video camera and is stored in the first memory 33*a* in the processing device 15.

(2) A preliminary center O' of the image is detected as a cross point between a major axis and a minor axis of the elliptical image of an outermost circle Q1 on the shooting target.

(3) A rectangular window W is set around the preliminary center O' such that at least an innermost ellipse Qn is included within the window. Then a major axis and a minor axis of the innermost ellipse are derived, and further a center O is detected as a cross point of these major and minor axes. It should be noted that the center O is detected near the preliminary center O', so that any measuring error may be ignored.

(4) From the center O of the shooting target image and an arbitrarily selected ellipse Q, there are derived XY coordinates having an origin as the center O, X axis as the major axis and Y axis as the minor axis.

(5) First and second distortion ratios are derived from coordinates (a1, 0) and (a2, 0) at which the ellipse Q intersects with the X axis and coordinates (0, b1) and (0, b2) at which the ellipse Q intersects with the Y axis in the following manner: first distortion ratio is expressed by b1/a1 and the second distortion ratio is denoted by b2/a2. The first distortion ratio is used when the bullet hole is existent on an upper side with respect to the X axis, and the second distortion is used when the bullet hole is on the lower side with respect to the X axis. From distances from the video camera 14 to respective points (a1, 0), (a2, 0), (0, b1) and (0, b2), a1=a2 and b1≠b2, so that the first distortion ratio b1/a1 is not equal to the second distortion ratio b2/a2.

(6) An after-shooting image of the shooting target 11 is picked-up and is stored in the second memory 33*b*. Then, the before-shooting image stored in the first memory 33*a* is subtracted from the after-shooting image stored in the second memory 33*b* to derive a difference image in which only the bullet hole image C' is remained.

(7) Coordinates (a, b) of the bullet hole C' are corrected in accordance with the first or second distortion ratio. When the bullet hole situates in a first area M above the X axis, a value b of the coordinates of the bullet hole is divided by the first distortion ratio b1/a1, and when the bullet hole is in a second area N below the X axis, a value b of the coordinates of the bullet hole is divided by the second distortion ratio b2/a2. In this manner, the coordinates (a, b) of the bullet hole C' in the picked-up substantially elliptically distorted image can be corrected into corrected coordinates (a, c).

(8) A distance between the corrected coordinate point (a, c) and the origin O is derived, and a score of shooting is made in accordance with the thus detected distance.

In the present embodiment, since natural light from the sun S is scattered by the reflection mirror 18 toward the camera 14 via the bullet hole C formed in the shooting target 11, the bullet hole is picked-up as a bright spot and large contrast can be obtained between the bullet hole and the front surface of the shooting target. Therefore, a position of the bullet hole can be detected accurately at a high speed. In this case, an amount of scattered light can be adjusted by suitably positioning the reflection mirror 18.

Furthermore, since the shooting target 11 is urged against the rear plate 20 by means of the holding frame 23, the shooting target could be effectively prevented from being swung by wind. Therefore, the before-shooting image and after-shooting image can be accurately coincided with each other, and the processing device 15 can be made simple and high speed. Since the video camera 14 is arranged in front of the shooting target 11 obliquely with respect to the shooting target, the shooting is not interrupted by the camera and it is not necessary to move the video camera. Therefore, a whole apparatus can be made simple, small and cheap, while shooting score can be made within a short time.

Moreover, the position of the bullet hole in the substantially elliptically distorted image of the shooting target can be corrected only by dividing the value b of the coordinates (a, b) of the bullet hole with the first or second distortion ratio b1/a1 or b2/a2. Therefore, position correcting program of the processing device 15 can be simplified. Then, cost of the processing device 15 can be decreased and an image processing time can be shortened.

The present invention is not limited to the embodiment explained above, but many modifications and alternations may be conceived by those skilled in the art within the scope of the invention. In the above embodiment, the reflection mirror 18 is constructed to reflect natural light from the sun S at a whole surface thereof. However, a peripheral surface area of the mirror outside a locus of the outermost circle of the shooting target is advantageously blackened, because a bullet hole may be formed in a peripheral white area of the shooting target. Further, in the above embodiment, the shooting target apparatus is provided in an open field such that natural light from the sun S is reflected by the reflection mirror 18. However, according to the invention, the shooting target apparatus may be arranged in a room at such a position that the shooting target 11 and reflection mirror 18 can be illuminated substantially uniformly.

In the above embodiment, the shooting target holding frame 23 is formed as a rectangular frame, but it may be formed circularly. Moreover, the shooting target holding frame 23 may be driven by any suitable driving mechanism. Further, the holding frame 23 may be driven by any other device than the shooting target exchange command device 32.

When the video camera 14 is fixed with respect to the shooting target 11, it is sufficient to calculate the first and second distortion ratios b1/a1 and b2/a2 only once. Then, a position of a bullet hole can be corrected at a high speed.

What is claimed is:

1. A shooting target apparatus comprising:

a shooting target;

an image picking-up means for picking-up an image of the shooting target to derive an image signal;

an image processing means for processing said image signal supplied from the image picking-up means to detect a position of a bullet hole formed in the shooting target by means of a bullet;

a scoring means for making a shooting score in accordance with said detected position of the bullet hole in the shooting target; and a light reflecting means provided on a line connecting said shooting target and said image picking-up means for reflecting light toward said image-picking up means via said shooting target;

wherein said light reflecting means includes adjustment means for aligning a light source, said shooting target and said image picking-up means; and said adjustment means includes a central axis for pivoting said light reflecting means thereabout for said aligning.

2. A shooting target apparatus according to claim 1, wherein said image picking-up means is arranged obliquely with respect to the shooting target.

3. A shooting target apparatus according to claim 1, wherein said light reflecting means comprising a light scattering surface.

4. A shooting target apparatus comprising a shooting target; a rear plate having a front surface on which said shooting target is arranged, and an opening through which a bullet can pass; a movable holding frame member, including upper and lower levers for pivoting the holding frame member away from the front surface of said rear plate, and a plunger for urging the holding frame member and the shooting target against the front surface of rear plate at a periphery of the shooting target; a shooting target box accommodating a plurality of shooting targets in a folded condition: and a take-up means including a pair of rollers and a driving motor for taking-up the plurality of shooting targets through a space between the holding frame member and the rear plate;

wherein the holding frame member and take-up means are arranged, so that when desired, the plunger is driven to move the holding frame member away from the front surface of the rear plate and the motor drives the rollers to place a new shooting target in front of said opening in the rear plate and then the plunger is arranged to urge the new holding frame member and the shooting target against the front surface of the rear plate at the periphery of the shooting target.

5. A shooting target apparatus comprising a shooting target; and image picking-up means for picking-up an image of the shooting target to derive an image signal, said image picking-up means being arranged obliquely with respect to the shooting target; an image processing means for processing said image signal supplied from the image picking-up means to detect a position of a bullet hole formed in the shooting target by means of a bullet; and a scoring means for making a shooting score in accordance with said detected position of a bullet hole in the shooting target; wherein said image processing means is constructed to correct a position of a bullet hole in a picked-up elliptically distorted image into a position of a bullet hole in a corrected circular image in accordance with a distortion ratio, and wherein the distortion ratio includes first and second distortion ratios of unequal values, and the first distortion ratio is used to correct the position of the bullet hole when the bullet hole is on a first side of an axis of the distorted image and the second distortion ratio is used to correct the position of the bullet hole when the bullet hole is on a second side of the axis of the distorted image.

* * * * *